United States Patent [19]

Besson et al.

[11] Patent Number: 4,620,797

[45] Date of Patent: Nov. 4, 1986

[54] ELECTRONIC TIME PIECE COMPRISING A DEVICE FOR ADJUSTING THE TIME DISPLAY

[75] Inventors: René Besson, Neuchâtel; Pierre-André Meister, Bienne, both of Switzerland

[73] Assignee: ETA SA Fabriques d'Ebauches, Granges, Switzerland

[21] Appl. No.: 772,572

[22] Filed: Sep. 4, 1985

[30] Foreign Application Priority Data

Sep. 5, 1984 [CH] Switzerland ..... 04251/84

[51] Int. Cl.[4] ..... G04B 19/22; G04B 19/04

[52] U.S. Cl. ..... 368/21; 368/80; 368/187

[58] Field of Search ..... 368/21, 22, 76, 80, 368/185, 187

[56] References Cited

U.S. PATENT DOCUMENTS

| | | | |
|---|---|---|---|
| 4,365,898 | 12/1982 | Wakai | 368/187 |
| 4,382,686 | 5/1983 | Giger et al. | 368/187 |
| 4,398,831 | 8/1983 | Fatton et al. | 368/185 X |
| 4,526,476 | 7/1985 | Nakayama et al. | 368/187 X |

*Primary Examiner*—Vit W. Miska

*Attorney, Agent, or Firm*—Griffin, Branigan & Butler

[57] ABSTRACT

A watch comprising at least a minute hand, an hour hand and a knobbed shaft which can occupy an extended axial position known as a correcting position.

Minute-by-minute correction or correction by whole time zones is operated with the knobbed shaft in the same extended position by the selection of the speed at which the knob is rotated. Time zone correction always uses as point of reference the real time at the moment of actuation of the knob into the extended position, and the watch includes means operative to cancel any step-by-step correction of the minute hand which may have preceded the time zone correction.

5 Claims, 5 Drawing Figures

ELECTRONIC TIME PIECE COMPRISING A DEVICE FOR ADJUSTING THE TIME DISPLAY

BACKGROUND OF THE INVENTION

1. Field of the Invention

The present invention relates to an electronic time piece comprising an hour indicator, a minute indicator and a manually actuable correction device which, when actuated, effects step-by-step correction in either direction of the minute indicator in response to a first given operation carried out on the device and rapid correction in either direction of the minute indicator by whole time zones in response to a second given operation, different from the first, carried out on the device.

2. Description of the Prior Art

Such time pieces are known. In the most recent models of electronic analog watches the correction device is in the form of a knobbed shaft reminiscent of those of mechanical watches and which the users are most accustomed to. Some of these models are designed to allow time-zone correction, that is to say an alteration of the display by whole hours. U.S. Pat. No. 4,398,831 describes as known a method which consists in selecting the information to be corrected, hours and minutes or time zones, by turning the shaft in one or the other direction whilst keeping it in its non-actuated position, and then in pulling the shaft out and turning it again to correct the information selected, the rotation of the shaft in one or the other direction allowing the watch to be adjusted forwards or backwards. The document cited also indicates that a method is known for altering the hour indicator (time zone) or the minute indicator by turning the adjusting shaft quickly or slowly respectively, the display moving backwards or forwards according to the direction of rotation.

This latter suggestion is interesting as it simplifies the correction operations which take place when the shaft is in an actuated position (i.e. when it is pulled out). The document cited mentions, however, that there is a risk of losing the time. This is in fact easily comprehensible. Assuming that for such a watch the user has first selected the hour (time zone) and minute correction with the shaft in its neutral position, that he has then pulled the shaft out into its correcting position and that in this position he wishes to proceed to a correction of the time zone, he must turn the shaft quickly. Thus, according to the direction of rotation of the shaft, the minute hand will make a complete turn forwards or backwards. However, if the movement of rotation is not effected quickly enough through clumsiness or simply lack of attention, an unwanted minute correction is made and the correct time is thus lost.

To reduce the inconvenience just mentioned, the document cited suggests a method for correcting the time zone indicator when the control device is in its neutral rest position, the correction of the minute indicator being effected when the shaft is actuated in its correcting position. This method is, however, lacking in logic as the user has to remember that the time zone can only be corrected when the shaft is in an axial position which is normally reserved for the selection of the data to be corrected. Furthermore, if the neutral position of the shaft is used for selecting data by slow rotation, the proposed method will not avoid an untimely correction of the time zone if the pin is turned rapidly when the said selection is being made.

SUMMARY OF THE INVENTION

Thus, the present invention proposes to provide a way of avoiding the problem of losing the time in a watch where the minute correction and the time zone correction are effected in the same actuated position of the correction instrument and by selection of the operation to be applied to the said instrument. In this way the time zone will always be corrected in relation to the real time when the correction instrument is actuated. Thus the possibility of losing the time is totally excluded.

The invention provides compensating means which cancel any correction of the minute indicator which may, owing to the manner of operation of the correction device by the user, precede a time zone correction. Accordingly the aforesaid second operation always effects a correction of a whole time zone relative to the time at the instant of actuation of the correction device.

BRIEF DESCRIPTION OF THE DRAWINGS

The invention will now be understood in the light of the following description and for a clear comprehension of this reference will be made, by way of example, to the drawings in which.

DESCRIPTION OF THE PREFERRED EMBODIMENTS

As was said above, the time piece according to the invention has at least an hour indicator and a minute indicator. To clarify, these indicators are on the one hand a minute hand and on the other an hour hand, this latter being mechanically linked to the first by a mechanical timer. The watch also has a knobbed shaft which can assume two axial positions. A first neutral pushed-in position allows the selection of the data to be corrected, these data being possibly, among other things, the hour, a timer function, a stopwatch function, etc. Selection is made by rotation of the knob. To make visible to the user which of the data has been selected these may be made to appear on a secondary display, for example a liquid crystal digital display.

If the user wishes to correct the hour display, which is the subject of this invention, he pulls the knob out into a second active position, after having selected the hour indicator. From this position, if he turns the knob slowly in one or other direction, he adds or subtracts minutes from the minute hand display. Thus, the hand will move forwards or backwards step by step, the user remaining master of the correction to be made. Also from this position if the user turns the knob quickly, in one or other direction, one adds or subtracts a whole time zone from the hour display, the minute hand making exactly one turn. These operations are known. For this reference may be made to the document cited above and U.S. Pat. No. 4,379,642.

As has already been said, the present invention proposes the correction of the minute hand and the correction of the time zone with the knob in the same active position without risk of losing the time if a minute correction precedes a time zone correction.

Figure 1:
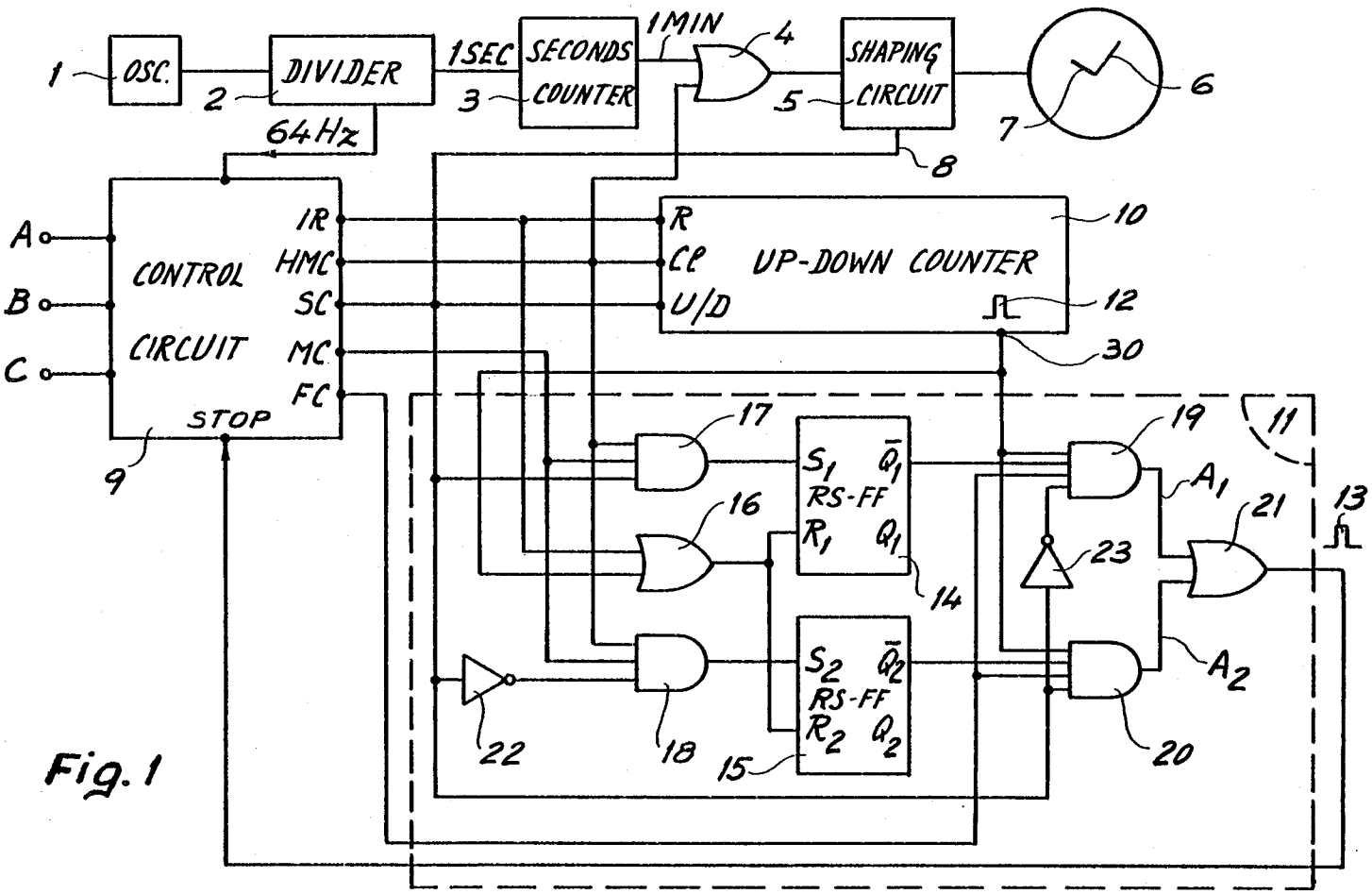
FIG. 1 is a diagram of a possible lay-out of the electronic circuit allowing the adjustment of the time piece according to the invention.

One embodiment for achieving the desired aim is shown in FIG. 1. It comprises, as is known from the prior art, a time base 1, such as a quartz oscillator, producing a signal at a high frequency, for example 32 kHz, a frequency divider 2 composed of a series of cascade-connected flip-flops and supplying a seconds counter 3 with a signal of normal time pulses the frequency of which is here set at 1 Hz. The seconds counter 3 supplies its output with a minute pulse which, via the OR circuit 4 and the shaping circuit 5, causes the minute hand 6 to advance by steps of one minute. The minute hand is driven by a stepping motor which is capable of operating in the two directions of rotation and the operating direction of which depends on the signal present on the line 8 of the shaping circuit 5. When the watch is operating normally this signal is of value "1" and the minute hand advances in a clockwise direction.

The watch also comprises a manual rotary control shaft with two axial positions, one being a rest position and one an operative position, which shaft is not shown in FIG. 1 and which, when it rotates, actuates two mechanical switches A and B which generate two signals, each formed of a succession of pulses of a frequency proportional to the speed of rotation of the control instrument and out of phase with one another, the sign of this phase difference depending on the direction of rotation. A third switch C, actuated by the control shaft when it is moved axially, provides a logic signal representing the position occupied by the shaft. These switches, described in detail in U.S. Pat. No. 4,398,831 cited above, act on a control circuit 9 which will not be described in detail here, on the one hand because it does not constitute part of the present invention and on the other because it is dealt with amply in the document cited and incorporated herein by reference.

To aid comprehension of that which follows, a summary is given below of the various functions of the block 9, clarifying what the signals are which it emits at its various outputs when the user actuates the switch C and then operates the knob causing the switches A and B to work.

1. When the shaft is pulled from the neutral pushed-in position to the active extended position, the block 9 emits a pulse known as a zero-reset pulse to its output IR (reset).

2. When the shaft is rotated slowly in its extended axial position (the interaction of switches A and B producing for example less than 4 pulses in 100 msec) isolated pulses appear at the output HMC of the block 9.

During this operation the block 9 emits a logic signal 1 at its ouput MC, which signal represents the step-by-step correction of the minute hand.

3. When the shaft is rotated quickly in its extended axial position (the interaction of switches A and B producing for example more than 4 pulses in 100 msec) a high frequency signal (for example 64 Hz and coming from the divider 2) appears at the output HMC of the block 9. During this operation the block 9 emits a logic signal 1 at its output FC, which signal represents rapid (time zone) correction.

4. When the user turns the knob to move the minute hand in a clockwise direction, the block 9 emits a logic signal 1 (up) at its output SC. When the knob is turned to move the minute hand in an anti-clockwise direction, the block 9 emits a logic signal 0 (down) at its output SC. These signals are emitted whatever the speed at which the hand is moving and they represent the direction of correction.

5. The block 9 is provided with a stop input. It interrupts the emission of the high frequency signal at its output HMC when a correction blocking pulse reaches this input.

FIG. 1 shows that block 9's output HMC (speed) is linked to the watch display via the OR circuit 4 and that the output SC (direction) is linked to the said display via the shaping circuit 5 by the line 8. Thus the minute hand moves step by step or rapidly in one or other direction according to how the knob is operated.

According to the invention the time piece comprises means for cancelling any minute correction which may precede a time zone correction when the correction device is actuated. In this way, in response to rapid rotation of the knob, a correction of a whole time zone always occurs in relation to the real time at the moment when the knob is set in its active extended position. In this way an untimely, undesired correction of a few minutes is not taken into account in the time zone correction which remains in line with the precise time.

FIG. 1 shows an example of means allowing the desired aim to be achieved. These comprise essentially an up/down counter 10 and a circuit 11 linked to the counter 10.

The up/down counter 10, well known, moreover, from the prior art, counts the pulses HMC arriving at its input CL. It can be reset to zero if a pulse is applied at its input R. It counts up if its input U/D (up/down) is at "1" and counts down if the said input is at "0". The counter used here has a capacity which is limited to 60, that is to say that beginning at zero it emits an output pulse 12, known as an overflow (carry or borrow) pulse, when its input CL has received 60 pulses whether it is counting up or down. In the special case when the counter 10 receives at its input CL some first pulses in the up direction (e.g. 5), then some second pulses in the down direction, the number of the said second pulses being greater than the number of the said first pulses (e.g. 10), it emits an output pulse 12, known as a "borrow" pulse, at the moment when its contents pass through zero. This is also true in the opposite down/up direction. The carry and borrow pulses 12 appear at the output of the counter in the same form and it is impossible to distinguish one from the other except by the fact that the first occurs without the U/D input changing its state whereas the second only occurs when there has been a change in the state of the said input U/D.

The circuit 11 linked to the counter comprises essentially two RS flip-flops or bistables 14 and 15. If a set pulse is applied to the input $S_1$, the flip-flop 14 presents a logic state "1" at its output $Q_1$ and a logic state "0" at its output $\overline{Q}_1$. The same is true of the flip-flop 15. Conversely if a reset pulse is applied to the input $S_1$, the flip-flop 14 presents a logic state "0" at its output $Q_1$ and a logic state "1" at its output $\overline{Q}_1$. The same is true of the flip-flop 15. It should be noted that the RS flip-flops selected here are of the master/slave type, that is to say that resetting to zero only takes place on the second edge of the control pulse sent to the inputs $R_1$ and $R_2$. This feature allows, as will be seen from what follows, a distinction to be made between a carry pulse and a borrow pulse issued at the output 30 of the counter 10.

To the reset inputs $R_1$ and $R_2$ are applied via an OR gate 16 either the pulses 12 presented at the output 30 of the counter 10, or a reset pulse IR which is given by the switch C when the correction device is actuated. Each set input $S_1$ and $S_2$ is controlled by an AND gate identified respectively as 17 and 18. These gates receive at their inputs the correction pulses HMC, the signal representing the direction of correction SC and the signal representing the step-by-step correction of the minute indicator MC. It will be observed that the signal SC is applied to the gate 17 just as it appears at the output of the block 9 whilst at the gate 18 it is inverted by the inverter circuit 22. To each output $\overline{Q}_1$ and $\overline{Q}_2$ of the flip-flops 14 and 15 there is connected an AND gate identified as 19 and 20 respectively. The outputs of the said gates 19 and 20 are connected to the inputs of an OR gate 21, the output of which issues a correction blocking pulse 13 to the stop input of the block 9. The other inputs of each of the AND gates 19 and 20 receive the signal representing the direction of correction SC, the signal representing rapid (time zone) correction FC and the output pulses 12 emitted by the counter 10. It will also be osberved that the signal SC is applied to the gate 20 just as it appears at the output of the block 9, whilst at the gate 19 this signal is inverted by the inverter circuit 23.

We shall now explain the functioning of the FIG. 1 layout by looking at a practical example of correction of the time zone alone. At the changeover from winter time to summer time, a watch needs to be put forward by one hour or, if preferred, the minute hand must be made to make one complete turn of 60 minutes in the forward direction. To do this, after the correction function has been chosen, the knobbed shaft is pulled out into its active axial position. The IR pulse which results from this sets at zero the counter 10 via its input R and the flip-flops 14 and 15 via their inputs $R_1$ and $R_2$. At this moment $Q_1$ and $Q_2$ are at "0" and $\overline{Q}_1$ and $\overline{Q}_2$ are at "1". Next the knob is rotated rapidly in the direction necessary to make the minute hand 6 advance by a whole time zone. Following this operation, assuming it has been done correctly, the output HMC of the block 9 produces pulses at 64 Hz which begin to increment the counter 10 in the forward direction as the signal representing the direction of correction SC is at level "1". At the same time the hand 6 advances rapidly as on the one hand pulses at 64 Hz are reaching it via the OR circuit 4 and on the other hand the shaping circuit 5 is receiving a forward command via the line 8. During the counting of the pulses the outputs of the AND gates 17 and 18 remain at zero since their inputs, which are receiving the signal representing a step-by-step correction MC are at zero. The state of the flip-flops 14 and 15 does not therefore change at this point and nor does the state "1" at the outputs $\overline{Q}_1$ and $\overline{Q}_2$. During this counting the two lower inputs of the AND gate 20 always change to "1" as the signals representing the direction of correction SC and the time zone FC are at "1".

Thus the three lower inputs of the AND gate 20 are at "1", a situation which allows the pulse 12 emitted at the end of the counting to pass through the AND gate 20 and to supply the output of the OR gate 21 with a correction blocking pulse 13 which stops the pulses at 64 Hz at the output HMC. The hand 6 will thus have moved forward through 60 divisions, each of one minute, thus advancing the hour hand 7 by one time zone. It will be observed that during this adjustment the lower input of the AND gate 19 is at zero, the signal SC being inverted by the inverter circuit 23.

At the changeover from summer time to winter time the watch has to be put back an hour. The operations which have just been described will be the same except that it will be necessary to rotate the knob in the opposite direction. At this moment the signal SC is at zero and it is the AND gate 19 which leads through the symmetrical arrangement of the circuit 11.

The existence of the circuit 11 would not be required if the correction only affected the time zone, in which case it can be seen that the output pulse 12 of the counter 10 would be used directly to stop the advance of the minute hand. However, as the desired aim is to propose a watch where step-by-step adjustment of the minute hand and alteration of the time zone take place with the knob in the same extended position, it will be understood that it is necessary to cancel any unwanted step-by-step correction of the minute hand which may precede a wanted time zone correction, if the user does not want to lose the time. This cancellation is achieved precisely by means of the arrangement shown in FIG. 1.

Two cases can occur, depending on whether the step-by-step correction is made in the same or the opposite direction to the direction of correction of the time zone. They will now be discussed with the help of examples.

(a) Corrections in the same direction

It is 4.45 when the user wishes to put the watch display forward by one hour. After selecting the double hour/minute function for correction, the user sets the knob in its active, extended position. Instead of rotating the knob rapidly he actuates it too slowly, which results in the minute hand being put forward by 5 minutes. If the watch were not equipped according to the present invention, a forward correction of one time zone occurring after this advance of 5 minutes would cause the hands to show 5.50 instead of 5.45.

Figure 2A:
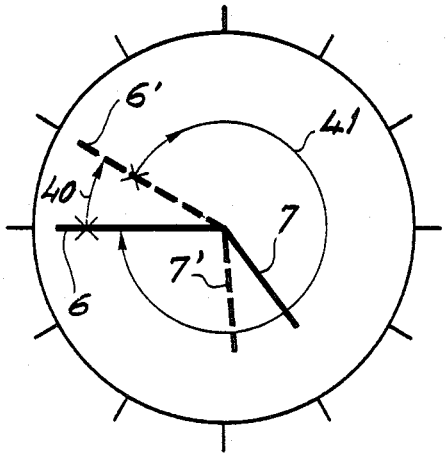
FIG. 2*a* is a representation of the course of the minute hand when the step-by-step correction of the said hand precedes the time zone correction and when the said corrections take place in the same direction.

FIG. 2*a* shows the course of the minute hand when the step-by-step correction of the said hand precedes the correction of the time zone and the said corrections occur in the same direction. At first the hour hand 7 and the minute hand 6 show 4.45. After an erroneous forwards correction of 5 minutes the minute hand occupies the position 6' and has advanced 30 deg. in the direction of the arrow 40. From this position a time zone correction made in the same direction will, according to the invention, make the hand advance by only 55 minutes in the direction of the arrow 41. The watch will show 5.45: the minute hand will once again be in position 6 and the hour hand in position 7'.

We shall now refer to FIG. 1 to explain the behaviour of the diagram in the case under consideration. As has already been said, the block 9 emits a reset pulse IR when the knob is moved into the correcting position. The counter 10 is set at zero and the outputs $\overline{Q}_1$ and $\overline{Q}_2$ of the flip-flops 14 and 15 are at level "1".

The knob is then rotated slowly, this movement causing the hand to advance by 5 minutes. The counter 10 will have been incremented by 5 pulses and the hand 6 will have advanced from 4.45 to 4.50 (see also FIG. 2*a*). During this operation the signal representing the direction SC is of value "1", the signal representing step-by-step correction MC is also of value "1" whilst the signal representing the time zone FC is at zero. The output of the AND gate 19 ($A_1$) remains at zero as it receives a zero signal from the inverter 23. This output $A_1$ will remain at zero at the time of the time zone correction as for the two corrections envisaged here SC is of value "1" (same forwards direction). During the step-by-step and then rapid advance the output of the AND gate 18 remains at zero as the output of the inverter 22 is of value zero. Thus the state "1" of the output $\overline{Q}_2$ of the flip-flop 15 is retained. The lower input of the AND gate 20 is at "1" and remains at "1" at the time of rapid advance.

When the knob is rotated rapidly, signals at 64 Hz are sent to the counter 10, which signals continue to increment the counter until 55 pulses have been introduced. These pulses cause the hand 6 to advance 55 steps. During this operation the three lower inputs of the AND gate 20 are at "1" because the signal FC representing the time zone is of value "1". This situation allows the AND gate 20 to transmit to its output $A_2$ the pulse 12 characteristic of the end of the counter 10's counting, a pulse which passes through the OR gate 21 and provides the block 9 with the correction blocking pulse 13 which interrupts the 64 Hz signal at the output HMC. The hand 6 will thus have moved forward through 60 divisions, each of a minute, in two phases, firstly of 5 minutes and then of 55 minutes. In relation to the real time, the 5 additional pulses will thus have been cancelled and only the time zone correction will really have occurred. In the case being considered here, it can be seen that the first pulse emitted by the counter is that which is used as a correction blocking signal.

Had the correction of 5 minutes and that of the time zone been made in an anti-clockwise direction, the end-of-counting pulse 12 would have passed through the AND gate 19 following the same reasoning as was used above, because of the level "0" present at the output SC of the block 9 and the symmetry of construction of the circuit 11.

Figure 3A:
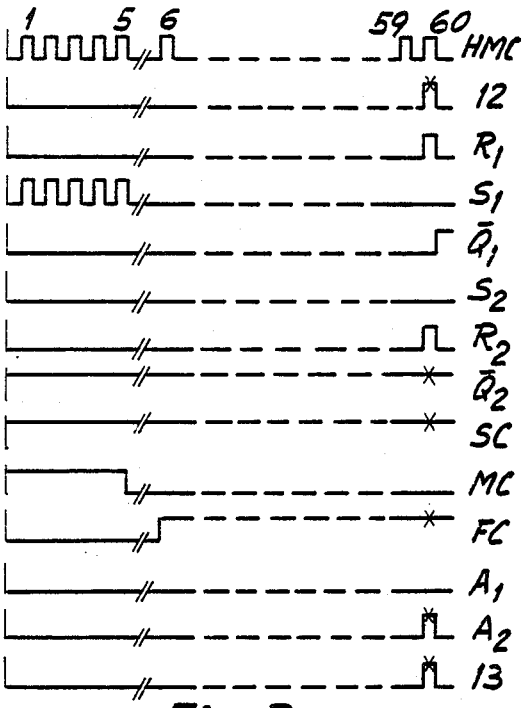
FIG. 3*a* is a diagram of signals illustrating the functioning of the circuit in FIG. 1 when the corrections are made according to the course in FIG. 2*a* and FIG. 3*b* is a diagram of signals illustrating the functioning of the circuit in FIG. 1 when the corrections are made according to the course shown in FIG. 2*b*.

FIG. 3*a* is a waveform diagram illustrating the operation of the circuit in FIG. 1 when the corrections are made according to the course shown on FIG. 2*a*. In the margin the various symbols used in FIG. 1 may be found. It can be seen that to the 5 isolated pulses HMC are added 55 subsequent pulses, a situation which produces the carry pulse 12. At this moment the coincidence of this pulse with the states "1" of the points $\overline{Q}_2$, SC and FC allows the said pulse to pass through the AND gate 20 ($A_2$) and to stop the block 9 (13). It can be observed that if the step-by-step correction and the rapid correction of the display are made in the same direction, the blocking signal 13 is emitted at the first of the pulses (12) emitted by the counter 10.

(b) Corrections in opposite directions

The watch displays 4.45 when the user wishes to put its display forward by an hour. After having selected the double hour/minute function for correction the user pulls the knob out into its active position. However, instead of the knob being rotated rapidly in the right direction for the minute hand to be moved rapidly forward, the said knob is actuated too slowly and in a direction such that the watch is put back by 5 minutes. The watch then shows 4.40. Without a means of cancelling the erroneous correction the display will show 5.40 instead of the 5.45 intended.

Figure 2B:
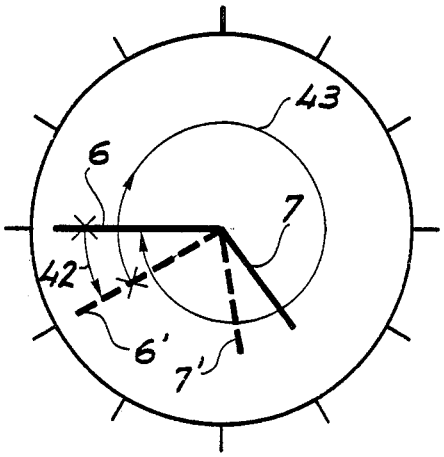
FIG. 2*b* is a representation of the course of the minute hand when the step-by-step correction of the said hand precedes the time zone correction and when the said corrections take place in opposite directions.

FIG. 2*b* shows the course of the minute hand when the step-by-step correction of the said hand precedes the time zone correction and when the said corrections occur in opposite directions. At first the hour hand 7 and the minute hand 6 indicate 4.45. After an erroneous backwards correction of 5 minutes, the minute hand occupies the position 6' having moved back 30 deg. in the direction of the arrow 42. From this position a correction of the time zone made in the other direction will according to the invention, make the hand advance by 65 minutes in the direction of the arrow 43. The watch will then show 5.45: the minute hand will once again be in position 6 and the hour hand in position 7'.

We shall now refer once again to FIG. 1 to explain how the operations indicated are realized. As in the case considered above, the block 9 emits a reset pulse at its output IR when the knob is moved into its correcting position. Thus the counter 10 and the flip-flops 14 and 15 are reset to zero, which means that the outputs $\overline{Q}_1$ and $\overline{Q}_2$ are at logic level "1".

The knob is then rotated slowly, causing the hand to move backwards by 5 minutes. The counter 10 will have been decremented with 5 pulses at its input CL in the "down" direction. During this operation the signal SC is of value "0", the signal MC is of value "1" and the signal FC is of value "0". This situation opens the AND gate 18 for the first pulse from the output HMC of the block 9 and causes the flip-flop 15 to switch, the circuit then presenting the level "0" at its output $\overline{Q}_2$. Consequently all the inputs of the AND gate 20 are at zero.

When the knob is rotated rapidly in the "up" direction pulses at 64 Hz are sent to the counter 10, which, after 5 pulses, emits a "passing through zero" or borrow pulse 12, which is repeated at the upper input of the AND gate 20. Before this borrow pulse arrives, the two lower inputs of the said AND gate 20 change to "1" (FC=1, SC=1). The borrow pulse, via the OR circuit 16, resets the flip-flop 15 to zero through its input $R_2$. The output $\overline{Q}_2$ changes to "1", but only (and this is a special feature of the flip-flops 14 and 15) on the second edge of the said borrow pulse. Thus the borrow pulse 12 which is presented to the upper input of the AND gate 20 is ahead of the transition to "1" of the input of the same gate linked to the output $\overline{Q}_2$ of the flip-flop 15. Consequently this pulse cannot pass through the AND gate 20 and does not stop in any way the block 9, which continues to supply a 64 Hz signal at its output HMC. From this moment the counter 10 will fill up to its nominal capacity and, after 60 pulses, will provide an output or carry pulse 12 to the upper input of the AND gate 20. As all the other inputs are at "1", the carry pulse passes through the AND gate 20 and supplies, at the output of the OR circuit 21, a correction blocking signal 13 which stops the emission of the 64 Hz signal at the output HMC of the block 9.

During the operations indicated above, the AND gate 19 remains permanently blocked as it receives a signal "0" from the inverter 23 at its lower input (SC=1).

Had the correction of 5 minutes been made in a clockwise direction and that of the time zone in an anti-clockwise direction, it would have been the AND gate 19 which would have been open and the AND gate 20 which would have been blocked.

Figure 3B:
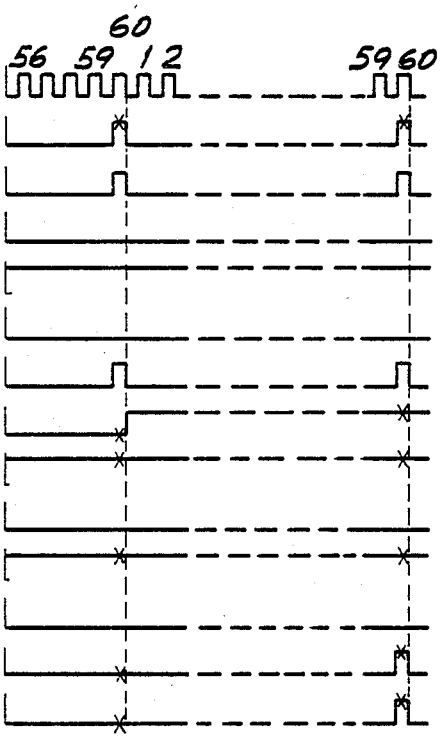

FIG. 3*b* is a waveform diagram illustrating the operation of the circuit in FIG. 1 when the corrections are made according to the course shown in FIG. 2*b*. It is assumed, however, that the slow, step-by-step correction in the down direction has already been made and the left side of the diagram begins at the moment when the hand is being rotated rapidly. It can be observed that the first output (borrow) pulse (12) cannot pass through the AND gate 20 because the signal $\overline{Q}_2$ is still at zero at that moment. It is only on the second emission of a (carry) impulse 12 by the counter 10 that the said pulse can pass through the AND gate 20, as the points $\overline{Q}_2$, SC and FC are at level "1".

To complete the explanations which have just been given it may be said that after the time zone correction the shaft is pushed back into its neutral position. If a correction of the minute hand is actually wanted, this correction is made without the subsequent time zone correction. After the shaft has been pushed back into its neutral position, this correction of the minute hand is confirmed as such. It should also be noted that during the correction operations the watch continues to show the real time, as the time base continues to supply forwards pulses to the display 6 via the OR circuit 4.

We claim:

1. An electronic time piece comprising at least an hour indicator, a minute indicator, a manually actuable correction device which, when actuated, effects step-by-step correction in either direction of said minute indicator in response to a first given operation carried out on said device and rapid correction in either direction of said minute indicator by whole time zones in response to a second given operation, different from the first, carried out on said device, and compensating means operative to cancel, when said correction device is actuated, any correction of said minute indicator which may precede a time zone correction, whereby said second operation always effects a correction of a whole time zone in relation to the real time at the moment said correction device is actuated.

2. A time piece according to claim 1, wherein said first and second operations generate correction pulses to correct said minute indicator display and that said compensating means comprise an up/down counter having a capacity which corresponds to the number of steps necessary for making a whole time zone alteration of the display, said counter storing said correction pulses and emitting an output pulse each time it overflows or underflows, and a circuit arranged to receive said output pulses and to supply, in response to said first and second operations, a correction blocking signal to the first output pulse emitted by said counter if the step-by-step correction and the rapid correction of the display are carried out in the same direction and to the second output pulse emitted by said counter if the said corrections are carried out one in a first direction and the other in a second direction.

3. A time piece according to claim 2, wherein the capacity of said counter is 60, each correction pulse corresponding to one display minute.

4. A time piece according to claim 2, wherein said counter has a reset input which receives a reset pulse when said correction device is actuated.

5. A time piece according to claim 2, wherein said circuit comprises first to fourth AND gates, first and second OR gates and two bistable devices, each having a reset input to which are applied via said first OR gate each of said output pulses from said counter and a reset pulse produced in response to the actuation of said correction device, the resetting being controlled by the second edges of said pulses, said bistable devices having set inputs connected to output of said first and second AND gates respectively, said AND gates having first inputs receiving said correction pulses, second inputs receiving a signal representing step-by-step correction and third inputs receiving complementary inputs indicating one sense and the other sense of correction respectively, said bistable devices having outputs connected to first inputs of said third and fourth AND gates respectively, said third and fourth AND gates having second inputs receiving said output pulses, third inputs receiving a signal representing rapid correction, fourth inputs receiving complementary inputs indicating one sense and the other sense of correction respectively and outputs connected to said second OR gate to provide said blocking signal.

* * * * *